United States Patent [19]

Wingen

[11] 4,161,898

[45] Jul. 24, 1979

[54] HEATED CUTTING DEVICE

[75] Inventor: Peter Wingen, Overath, Fed. Rep. of Germany

[73] Assignee: Dienes Werke GmbH & Co. K.G., Overath-Vilkerath, Fed. Rep. of Germany

[21] Appl. No.: 883,255

[22] Filed: Mar. 3, 1978

[30] Foreign Application Priority Data

Apr. 14, 1977 [DE] Fed. Rep. of Germany ..... 2716703

[51] Int. Cl.[2] ..... B26F 3/10

[52] U.S. Cl. ..... 83/171; 83/508.1; 83/563; 83/676

[58] Field of Search ..... 83/171, 16, 676, 508.1, 83/563; 30/140; 128/303.14; 219/221, 241

[56] References Cited

U.S. PATENT DOCUMENTS

| | | | |
|---|---|---|---|
| 1,361,442 | 12/1920 | Campbell | 30/140 X |
| 1,636,530 | 7/1927 | Nyhus | 83/171 |
| 3,126,889 | 3/1964 | Blumenfeld | 83/171 X |

*Primary Examiner*—Frank T. Yost

[57] ABSTRACT

A heated cutting device includes a cutting disc having a circular peripheral cutting edge and being rotatably mounted on a carrier. An arcuate electrical heating element is mounted on the carrier in close proximity to an arcuate portion of the cutting edge for heating same.

10 Claims, 2 Drawing Figures

HEATED CUTTING DEVICE

Figure 1:
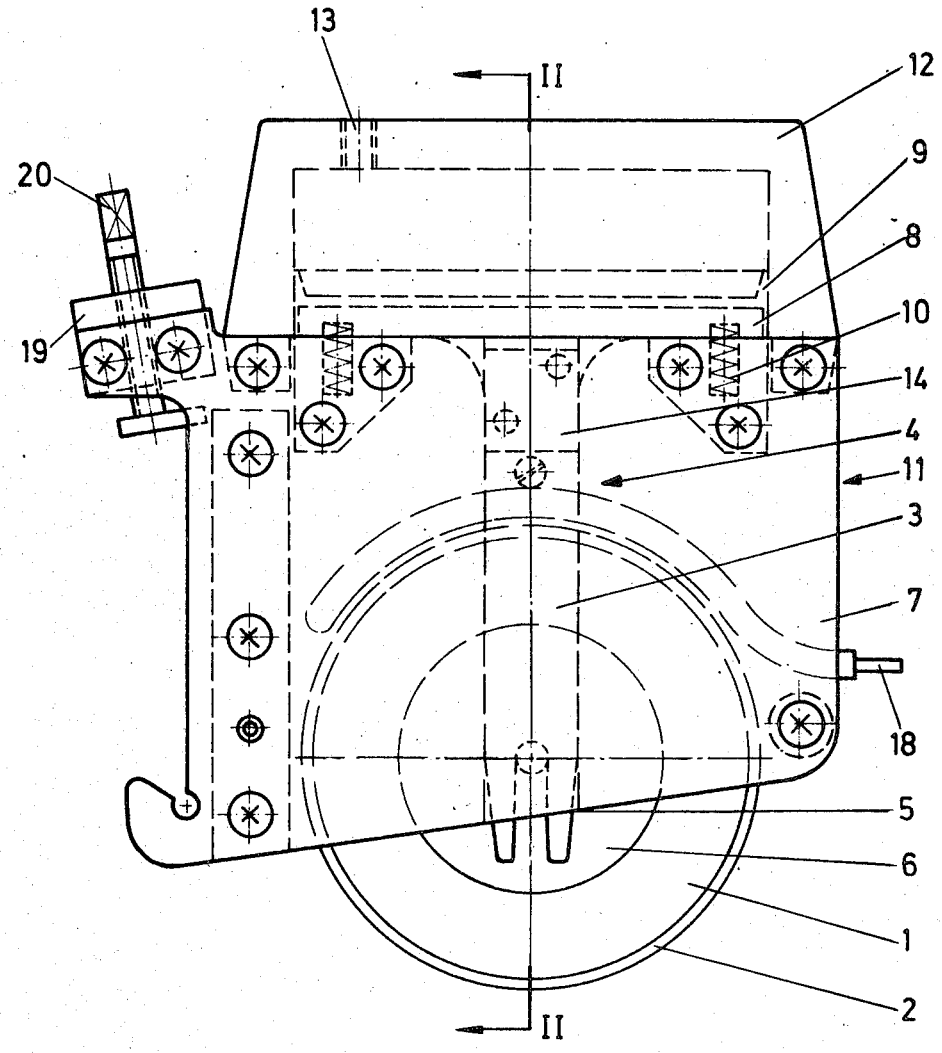

The invention relates generally to cutting devices and, more particularly, to heated cutting devices. The invention relates particularly to cutting devices for use in roll slitting apparatus or the like wherein a cutting disc is rotatably mounted on a carrier positioned in a holder. The cutting disc is heated by an elongated arcuate heating element mounted on the carrier within the housing in close proximity to the peripheral edge of the cutting disc.

Apparatus for slitting rolls of adhesive coated foil or other materials common use heated cutting devices to prevent the adhesive from sticking to the cutting device. Known apparatus of this type includes a hold-down beam on which cutting devices are mounted. The cutting devices are movable toward a pressure or back-up roller under the influence of suitable biasing means, such as a piston and cylinder arrangement. Strip material passing longitudinally between the roller and the cutting device is slit longitudinally.

In apparatus of the type described, the cutting devices commonly include a forked carrier having spaced opposite arms between which a cutting disc is rotatably mounted. A housing for the carrier and the cutting disc has an elongated narrow opening through which the cutting disc projects. A piston and cylinder arrangement is provided in the housing for biasing the carrier in a direction to extend the cutting disc through the housing opening. The narrow dimension of the housing and opening is parallel to the rotational axis of the cutting disc. The housing includes spaced side plates having grooves extending away from the housing opening and slidably receiving the cutting disc carrier.

A plurality of cutting devices of the type described are positioned on the hold-down beam of the roll slitting apparatus at spaced intervals corresponding to the desired widths of the strips to be cut from the sheet material. The width of the narrowest strip which can be cut is approximately equal to the dimension of the cutting device housing parallel to the rotational axis of the cutting disc. Therefore, the housing must be as narrow as possible parallel to the rotational axis of the cutting disc. When cutting adhesive coated foil, or other adhesive coated materials, the cutting edge of the cutting disc must be heated in order to soften the adhesive and prevent same from adhering to the cutting disc during the slitting process.

Electrical resistance heaters have been difficult to install in cutting devices of the type described for achieving optimum heating of the cutting edge on the cutting disc. In one known arrangement, an electrical heating element is mounted in the hub of the cutting disc and rotates with the disc. This requires the supply of electrical power to the heating element through slip rings and brushes. Malfunctions frequently occur due to wear and due to dirt deposits between the electrical contact surfaces. In addition, replacement of the cutting disc when it dulls also means that the electric heating element will be discarded even though it is not subject to rapid wear. Therefore, an arrangement of this type is very uneconomical.

In another known arrangement, the electrical heating element is in the form of a tube mounted in the housing in a position where it encloses the upper portion of the forked cutting disc carrier in frictional heat conducting contact therewith. During the slitting process, the entire cutting device vibrates, and the relative movement between the heating element and the cutting disc carrier causes rapid wear of the carrier and the heating element.

In previous arrangements of the type described, along with other arrangements, there is considerable heat loss through the cutting disc carrier and the side plates of the housing.

It is therefore the primary object of the present invention to provide a cutting device of the type described with an electrical heating element positioned for efficiently heating the cutting edge of the cutting disc without having substantial heat losses to the housing or carrier.

It is a further object of the present invention to provide a cutting device of the type described with a heating element in such a manner that the device is very economical to manufacture and maintain, and is not highly subject to rapid wear.

It is an additional object of the present invention to provide a cutting device of the type described with an elongated arcuate heating element mounted between the arms of the forked cutting disc carrier in close proximity to the cutting edge of the cutting disc.

An aspect of the present invention resides in having an elongated arcuate heating element tube mounted between the arms of the cutting disc carrier within the housing and in close proximity to a substantial arcuate portion of the cutting edge on the cutting disc. The heating element moves with the carrier relative to the housing and always remains at the same close spacing to the cutting edge on the cutting disc. The arms of the cutting disc carrier are deformed at locations spaced from the peripheral edge of the cutting disc to define mounting portions for the heating element. A sleeve of heat insulating material is interposed between the mounting portions and the heating element. With this arrangement, heat is transferred by direct radiation from the heating element to the peripheral cutting edge of the cutting disc. This substantially reduces heat losses to the carrier or housing, particularly when a sleeve of heat insulating material is interposed between the carrier and the heating element. The heating element is mounted to the carrier within the housing in the space existing between the top of the cutting disc and the piston-cylinder biasing arrangement. Therefore, the axial dimension of the housing is not increased.

For a better understanding of the present invention, together with other and further objects thereof, reference is had to the following description taken in connection with the accompanying drawings, and its scope will be pointed out in the appended claims.

Figure 2:
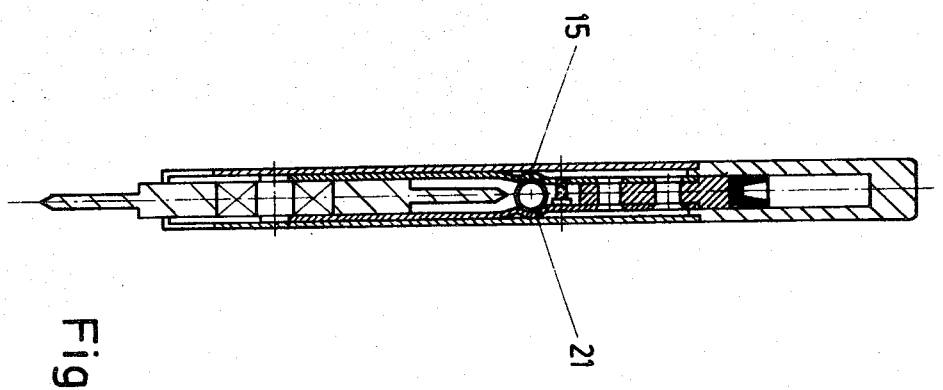

In the drawing:

FIG. 1 is a side elevational view of a cutting device having the improvements of the present invention incorporated therein; and FIG. 2 is a cross-sectional elevational view taken generally on line II—II of FIG. 1.

With reference to the drawing, there is shown a cutting disc 1 having a sharpened circular peripheral cutting edge 2, and being suitably rotatably mounted as in a bearing assembly 6 between the end portions of spaced opposite flat arms 3 of bifurcated or forked cutting disc carrier means 4. The arms 3 are slidably or reciprocatingly guided in flat inner grooves 5 in spaced opposite side plates 7 which substantially enclose the cutting disc 1 on both sides thereof with no play. The housing for the cutting disc 1 has an elongated narrow opening through which the cutting disc 1 projects. The opposite longitudinal edges of the cutting disc opening are defined by the bottom edges of the side plates 7. Biasing means is provided for biasing the carrier means 4 and the cutting disc 1 in a direction to extend the cutting disc 1 outwardly through the housing opening. In one arrangement, the biasing means takes the form of a piston 8 mounted in a cylinder 9. Separate springs 10 suitably mounted in the housing act on the piston 10 for biasing same upwardly in a direction to retract the cutting disc 1 within the housing.

The relatively flat box-like housing 12 for the biasing means has a fluid inlet 13 in the cover thereof for supplying fluid to the cylinder 9. The opposite side walls of the housing 12 lie flush with the side plates 7 defining part of the housing or guide means 11 for the cutting disc carrier means 4. The interior of the housing portion 12 is approximately oval as viewed in plan view.

The cutting device includes a holding means 19 extending from the left of the housing or guide means 11 in FIG. 1. The holding means includes a locking screw 20. The holding device 19 provides adjustable mounting of the cutting device to the hold-down of a roll slitting apparatus or the like.

A plurality of cutting devices of the type described are mounted in a known manner upon the rectangular hold-down beam of a roll slitting apparatus. The cutting devices are adapted to move parallel to the hold-down beam and parallel with the rotational axis of the cutting disc 1. The cutting devices can be locked in place on the hold-down beam after selecting the desired widths of the strips to be cut. The cutting discs act against smooth and glass hard steel rolls which feed the sheet material to be slit. The material travels between the rolls and the cutting discs for slitting same longitudinally into strips.

Between the opposite side plates 7, and between the upper or back portion 14 of the carrier means 4 and the cutting edge 2, the arms 3 are deformed to define mounting portions 15 as shown in FIG. 2. The mounting means 15 is provided by deforming the arms 3 into shallow generally U-shaped configurations providing opposite arcuate receiving portions. The mounting portions 15 receive an arcuate tubular electrical heating element 18 which extends between plates 7 in spaced relationship thereto. The longitudinal axis of the heating element 18 is curved so it extends over a substantial arcuate portion of the cutting edge 2 in close proximity thereto. A sleeve 21 of suitable heat insulating material, such as ceramic, is interposed between the heating element 18 and the mounting portions 15. The electrical heating means 18 moves with the carrier means 4 and the cutting disc 1, and always remains in the same closely spaced relationship to the cutting edge 2.

With the cutting device of the present application, it is possible to achieve direct radiation heating of the cutting edge 2. For example, with a spacing of approximately 2 millimeters between the heating element 18 and the cutting edge 2, it is possible to obtain a cutting edge temperature of approximately 60° C. as required for satisfactory slitting of adhesively coated foil. This is accomplished with a low voltage tubular heating element consuming only approximately 90 watts of power. This is also carried out with a cutting disc 1 of the usual diameter of approximately 80 millimeters.

The width of the cutting device parallel to the rotational axis of the cutting disc 1 is only approximately 9 millimeters and still accommodates the heating element 18 in spaced relationship to the side plates 7. Therefore, it is possible to slit strips to a width of only around 0.9 centimeters. At that time, the loss of heat into the housing of the cutting device becomes noticeable even though it is relatively small. In order to prevent distortion of the housing parts due to heat from the heating element 18, it is possible to form the housing parts of carbon steel instead of the usual steel used for die casting or injection molding. The carbon steel housing is highly resistant to distortion by heat.

The grooves 5 in the plates 7 slidably receiving the arms 3 of the carrier means 4 extend generally in a direction toward and away from the plane of the opening in the housing through which the cutting disc 1 projects.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. A cutting device for use in roll slitting machines or the like comprising: carrier means for rotatably carrying a cutting disc, a cutting disc rotatably mounted on said carrier means and having a circular peripheral edge, arcuate electric heating means for heating said peripheral edge during rotation of said cutting disc, and said heating means being mounted on said carrier means and extending along an arcuate portion of said peripheral edge in closely spaced relationship thereto.

2. The cutting device of claim 1 including a housing in which said carrier means is mounted, said housing having an opening through which said cutting disc projects, said carrier means being movable relative to said housing for extending said cutting disc outwardly through said opening, and said heating means being mounted on said carrier means within said housing.

3. The cutting device of claim 1 including heat insulating means interposed between said carrier means and said heating means.

4. The cutting device of claim 1 wherein said carrier means comprises a bifurcated carrier having a pair of spaced-apart elongated arms between which said cutting disc is rotatably mounted, and said heating means being mounted between said arms.

5. The cutting device of claim 4 wherein said heating means comprises a tubular heating element and said arms are deformed at a location spaced outwardly from said peripheral edge to define opposed mounting portions between which said heating element is received.

6. The cutting device of claim 5 including a sleeve of heat insulating material interposed between said heating element and said mounting portions.

7. The cutting device of claim 1 including a housing having a pair of opposite spaced-apart side plates with elongated internal grooves slidably receiving said carrier means, said housing having an opening through which said cutting disc projects, said grooves extending in a direction toward and away from the plane of said opening, and biasing means for biasing said carrier means in a direction for extending said cutting disc outwardly through said opening.

8. The cutting device of claim 7 wherein said biasing means comprises a fluid cylinder forming part of said housing and having a piston connected with said carrier means, and said housing being formed of carbon steel.

9. A cutting device for use in roll slitting machines or the like comprising: a housing having an elongated narrow opening, a cutting disc having a circular peripheral edge and being rotatably positioned on a carrier mounted in said housing for movement relative thereto in a direction for projecting said cutting disc outwardly through said opening, an elongated tubular electric heating element mounted on said carrier in spaced relationship to said housing for heating said peripheral edge, said heating element being positioned in close outwardly-spaced relationship to said peripheral edge and being curved along its longitudinal axis to follow the curvature of said peripheral edge over a substantial arc.

10. The cutting device as defined in claim 9 wherein said carrier comprises a bifurcated carrier having a pair of substantially parallel spaced-apart arms between which said cutting disc is mounted, said arms being deformed within said housing in outwardly spaced relationship to said peripheral edge to define mounting portions between which said heating element is received, and heat insulating material interposed between said mounting portions and said heating element.

* * * * *